US006822549B2

(12) United States Patent
Wolfgram

(10) Patent No.: US 6,822,549 B2
(45) Date of Patent: Nov. 23, 2004

(54) METHOD FOR INCREASED COUPLING COEFFICIENT IN A PULSE TYPE TRANSFORMER THROUGH COIL CONFIGURATION AND VARIED CORE AREA

(75) Inventor: Kirk W. Wolfgram, Rochester, MN (US)

(73) Assignee: Wolfgram Industries, Inc., Rochester, MN (US)

( * ) Notice: Subject to any disclaimer, the term of this patent is extended or adjusted under 35 U.S.C. 154(b) by 90 days.

(21) Appl. No.: 09/999,384

(22) Filed: Dec. 3, 2001

(65) Prior Publication Data

US 2003/0102948 A1 Jun. 5, 2003

(51) Int. Cl.[7] ..... H01F 27/24
(52) U.S. Cl. ..... 336/212; 336/182
(58) Field of Search ..... 336/83, 180–185, 336/188, 189, 195, 196, 198, 206–208, 212, 233, 234

(56) References Cited

U.S. PATENT DOCUMENTS 3,187,208 A * 6/1965 De Graaff ..... 336/212
3,691,497 A * 9/1972 Bailey et al. ..... 336/192
4,518,941 A * 5/1985 Harada ..... 336/183

FOREIGN PATENT DOCUMENTS

JP 05-343238 * 12/1993

* cited by examiner

*Primary Examiner*—Tuyen T. Nguyen

(57) ABSTRACT

The present invention provides a high peak current, low duty cycle, pulse type transformer with two methods of increasing the coupling coefficient between the primary and secondary windings. The first method provides an increased coupling coefficient for a pulse type transformer of a coreless design by increasing the number of secondary turns in proximity to a number of primary turns by providing multiple primary windings and multiple secondary windings configured in layers or winding bays in an alternating secondary, primary, secondary, primary configuration. The second method provides an increased coupling coefficient for a pulse type transformer with a magnetic core that utilizes a non-uniform cross-sectional area along the magnetic path where the cross-sectional area is increased within the primary and secondary windings. Both methods significantly increase the coupling coefficient in applications where the transformer is subjected to high peak current applications such as capacitive discharge circuits typically used in strobe circuits, electric fence controllers, and high performance ignition systems for automobile, motorcycle, or marine engines.

3 Claims, 6 Drawing Sheets

Showing Core Area at Two Points Along the Magnetic Path

FIG. 3 Showing Core Area at Two Points Along the Magnetic Path

METHOD FOR INCREASED COUPLING COEFFICIENT IN A PULSE TYPE TRANSFORMER THROUGH COIL CONFIGURATION AND VARIED CORE AREA

FIELD OF INVENTION

The present invention relates to a pulse type transformer intended to be used in a high current pulse type application such as a capacitive discharge type circuit, and in particular, to the number of primary and secondary windings and their physical relation and proximity to each other in a transformer of a coreless design.

The present invention also relates to a pulse type transformer intended to be used in a high current pulse type application such as a capacitive discharge type circuit, and in particular, to the cross-sectional area of a transformer's core along the core's magnetic path as related to the location of the primary and secondary windings.

BACKGROUND OF THE INVENTION

Transformers are electrical devices used to supply power or a signal from an AC source to an AC load. They may also be used to electrically isolate the load from the supply. Transformers consist of one or more input or primary windings along with one or more output or secondary windings which are electrically coupled together through a magnetic material and through the air. The relationship between the amount of power provided from the secondary windings in reference to the amount of power provided to the primary windings is referred to as the coupling coefficient. A change in the coupling coefficient can be provided through a change in core material, core size, winding material, winding size, proximity of the primary windings to the core, proximity of the core to the secondary windings, proximity of the primary windings to the secondary windings, along with change to several other parameters. Although transformers are typically referred to as AC devices, pulsing DC into a transformer's primary winding causes a change in the magnetic field allowing the transformer to function.

Transformers can be classified into two groups, AC, and pulse type. The AC type transformer can be subdivided into transformers without magnetic cores and transformers with magnetic cores.

The AC type transformer provided without a magnetic core is typically used in high frequency applications such as radio and TV circuits. AC transformers used in high frequency applications are not generally used for power but are used to pass low power signals from the primary to secondary winding. In medium and low frequency applications, coreless transformers are not used because the coupling coefficient is low providing minimal power or signal from the secondary winding. The AC transformers used in high frequency applications are also generally constructed with a single primary winding and single secondary winding that are placed in close proximity to each other such that the energy in the primary winding is radiated to the secondary winding similar to a radio wave. In addition, several AC type transformers used in radio and TV circuits have a very low material cost to manufacturer since they consist primarily of wire and a paper tube or insulator to wind the wire around. This lower cost coreless design would be advantageous if applied to lower frequency, higher power applications where product cost is an important part of the products specification provided the coupling coefficient were increased to meet product specifications.

The AC type transformer provided with a core is typically used in medium and low frequency applications such as power supply and audio circuits. The construction method for these transformers typically consists of winding the primary winding and secondary winding around an insulator or on a bobbin such that the primary and secondary windings are wound around a magnetic core material and such that the primary windings are separated from the secondary windings either by insulation or by being placed on separate locations along the magnetic path of the magnetic material.

The AC transformers used in these medium and low frequency applications may also be provided with more than one primary winding and may also be provided with more than one secondary winding. In AC type transformers with magnetic cores where multiple primary and multiple secondary windings are used, the primary windings are typically kept separate from the secondary windings to provide isolation from primary to secondary and to reduce manufacturing costs. However; in some cases where large transformers are used for applications such as power distribution by utility companies, the primary and secondary windings are wound with alternating primary and secondary windings to decrease the distance between the primary windings and secondary windings in order to provide a slight increase in the coupling coefficient. The transformer construction for these large AC type transformers with alternating primary and secondary windings always includes a magnetic core.

The magnetic materials used in the AC transformer construction vary in shape, size and material. In all cases, the magnetic core must have a complete path (including gaps through air) for the magnetic field in order for the transformer to function efficiently. To minimize resistances within the magnetic field, the air gaps are reduced to a minimum, and core designs are such that the cross-sectional area of the core along the magnetic path is as close to constant as possible. Changes in cross-sectional area along the magnetic path such that the cross-sectional area is not constant, results in a decrease in the coupling coefficient. Although a loss is created by an inconsistent cross-sectional core area, some transformers change the cross-sectional area within a high voltage winding to provide additional distance between the core and high voltage windings. These changes to the cross-sectional area of the core area are limited to within a high voltage winding and do not increase the cross-sectional area of the core within the windings as compared to the cross-sectional area of the core outside the windings.

The second general classification of transformer is the pulse type transformer. Pulse type transformers are similar to the AC transformer provided with a core in construction because they may be provided with multiple primary or secondary windings. They are also similar because they are provided with a magnetic core where the cross-sectional area of the core is constant along the magnetic path with the exception of within a high voltage winding as in the AC transformer.

The pulse type transformer differs from the AC transformer. While the AC transformer is subjected to sinusoidal AC, the pulse type transformer is subjected to repetitive DC pulses, off-periods between pulses, along with the rise-time and fall-time associated with the pulse. As the off-period is increased in the pulse type transformer, the energy in the DC pulse can also be increased without causing over-heating. This increase in pulse energy requires the pulse type transformer be able to withstand high voltages and high peak currents compared to the AC type transformer.

When the current in the primary winding is significantly increased in applications, (such as capacitive discharge circuits typically used in strobe circuits, electric fence controllers, and high performance ignition systems for automobile, motorcycle, or marine engines), the transformer's coils and magnetic core material behave differently in two ways. First, the primary and secondary windings behave differently in that their proximity to each other provides a significant effect on the coupling coefficient. Second, the cross-sectional area of the core within the primary winding and secondary winding have a more significant effect on the coupling coefficient than the cross-sectional area of the core that is not within the primary winding or secondary winding.

SUMMARY OF THE INVENTION

In accordance with the present invention there are several embodiments of a novel high current, low duty cycle, pulse type transformer which include a method of increasing the coupling coefficient through multiple primary and secondary windings and their proximity to each other in a transformer of a coreless design, and which include a method of increasing the coupling coefficient through change in the cross-sectional area of a magnetic core along the magnetic path of the core in a transformer designed with a magnetic core.

The invention utilizes a coreless pulse type transformer with multiple primary windings and multiple secondary windings physically arranged such that groups of secondary windings are separated by groups of primary windings. The coil construction method of placing groups of primary windings between groups of secondary windings in close proximity to each other significantly increases the coupling coefficient for transformers subjected to high supply current, low duty cycle transformers used in applications such as capacitive discharge circuits typically used in strobe circuits, electric fence controllers, and high performance ignition systems for automobile, motorcycle, or marine engines. Although the coreless design requires higher peak supply currents, costs associated with increases in the peak supply current necessary to drive such a coreless transformer may be offset by the reduction in the coreless transformer cost compared to a transformer designed with a magnetic core.

The invention also utilizes a pulse type transformer with one or more primary windings, one or more secondary windings, and a magnetic core where the cross-sectional area of the magnetic core changes along the magnetic path of the magnetic core such that the cross-sectional area is significantly increased within the primary windings and/or secondary windings. Given a volume of core material with a constant cross-sectional area along the magnetic path, a transformer will have a given coupling coefficient. Increasing the cross-sectional area of the core area within the primary and/or secondary windings provides an increase in the coupling coefficient by a given value. Decreasing the cross-sectional area of the same core outside the primary and secondary windings by the same amount as the increase within the windings decreases the coupling coefficient by a value that is less than the increase in coupling coefficient associated with the increase in cross-sectional area within the windings. The result is an increase in the coupling coefficient for the same volume and cost of core material for a pulse type transformer that subjected to high supply current, low duty cycle applications such as capacitive discharge circuits previously mentioned like those used in strobe circuits, electric fence controllers, and high performance ignition systems for automobile, motorcycle, or marine engines.

DETAILED DESCRIPTION OF THE INVENTION

Figure 1:
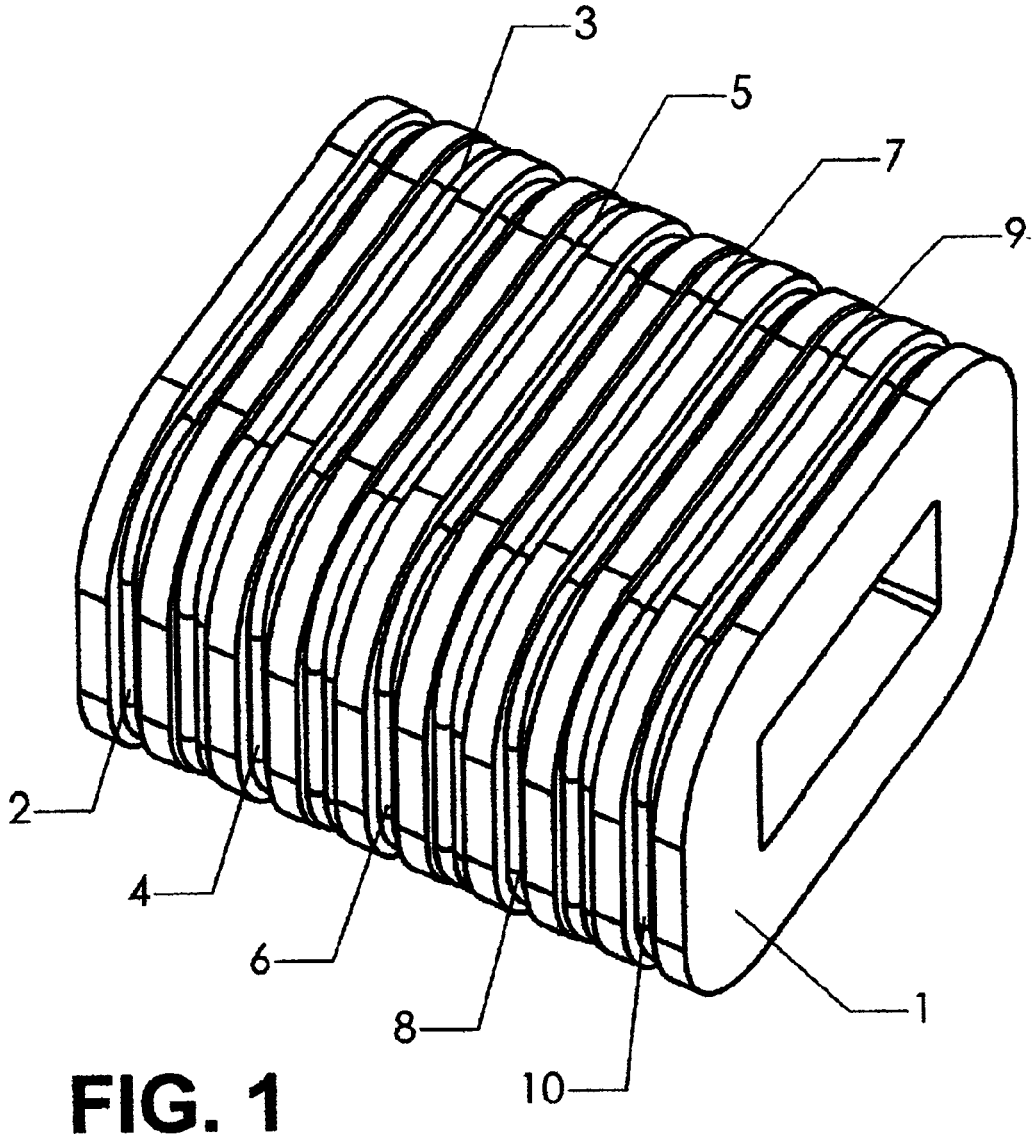
FIG. 1 is an isometric view of a preferred embodiment of the coil invention using a bobbin construction.

FIG. 1 shows a preferred embodiment of the coreless pulse type transformer of the invention and the proximity of multiple primary windings to multiple secondary windings using a bobbin construction. In FIG. 1, a bobbin 1 is provided for insulation and as a frame to wind all transformer windings. The bobbin 1 provides four locations or winding bays for primary windings and five locations or winding bays for secondary windings. The primary is split into multiple windings 3, 5, 7, 9 and wound in separate winding bays. The secondary is also split into multiple windings 2, 4, 6, 8, 10 and wound in separate winding bays located between the winding bays used for the primary windings 3, 5, 7, 9. The primary and secondary windings alternate winding bays starting with secondary winding 2, primary winding 3, secondary winding 4, primary winding 5, as shown. The alternating primary and secondary windings in the coreless pulse transformer increases the number of primary windings in proximity to the number of secondary windings and increases the coupling coefficient of the transformer compared to standard coreless transformers where the primary winding or windings is located in one area and the secondary winding or windings is located on another area. Although other transformers presently use a similar alternating primary winding secondary winding construction method, these transformers are limited to power transformers requiring a magnetic core where high efficiency is a requirement. The coreless transformer design utilizing the alternating primary winding secondary winding design does not provide as high of coupling coefficient as transformers using a magnetic core. However, costs associated with increases in the supply current necessary to drive such a coreless transformer may be offset by the reduction in the coreless transformer cost compared to a transformer designed with a magnetic core.

Figure 2:
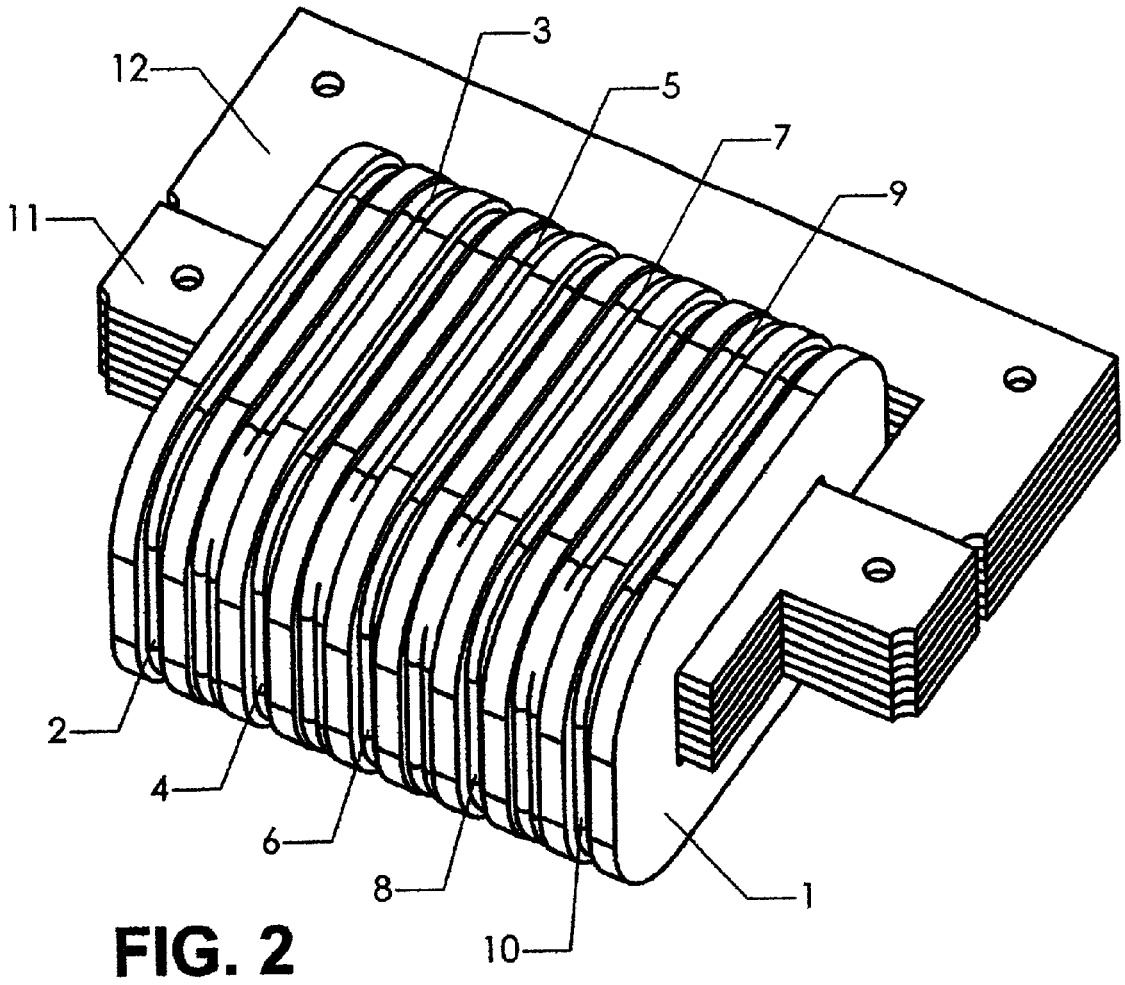
FIG. 2 is an isometric view of the coil construction shown in FIG. 1 along with a preferred embodiment of the magnetic core invention.
Figure 3:
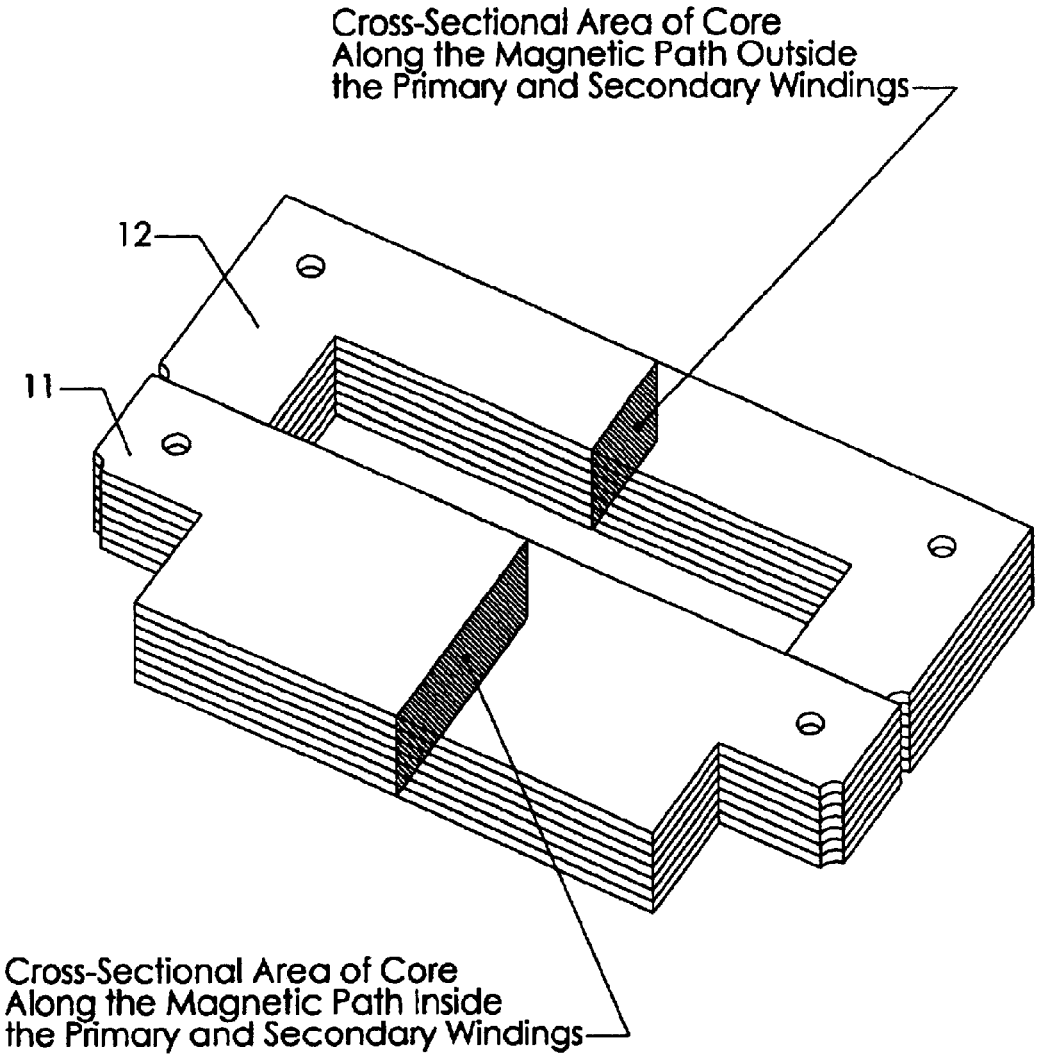
FIG. 3 is an isometric view of the preferred embodiment of the magnetic core invention shown in FIG. 2.

FIG. 2. shows the coil used in FIG. 1 along with a preferred embodiment of the magnetic core of the invention in relation to primary and secondary windings. FIG. 3 shows the magnetic core in FIG. 2 and the general shape related to the cross-sectional area within the primary and secondary windings along the magnetic path as compared to the cross-sectional area along the magnetic path outside the primary and secondary windings. The magnetic core is provided using two stacks of stamped transformer laminations. The first stack of transformer laminations 11 increases in width as it passes through the primary and secondary windings thus increasing the cross-sectional area of the core within the windings. The second stack of transformer laminations 12 remains at the same narrow width outside the primary and secondary windings. This increased cross-sectional area within the primary and/or secondary windings provides an increased coupling coefficient for a high peak current, low duty cycle, pulse type transformer without increasing the manufacturing cost. Although transformers have been produced with change in cross-sectional area along the magnetic path, the change has occurred within a winding to increase spacing in areas of high voltage and not to change the cross-sectional area within the windings compared to the cross-sectional area outside the windings.

Figure 4:
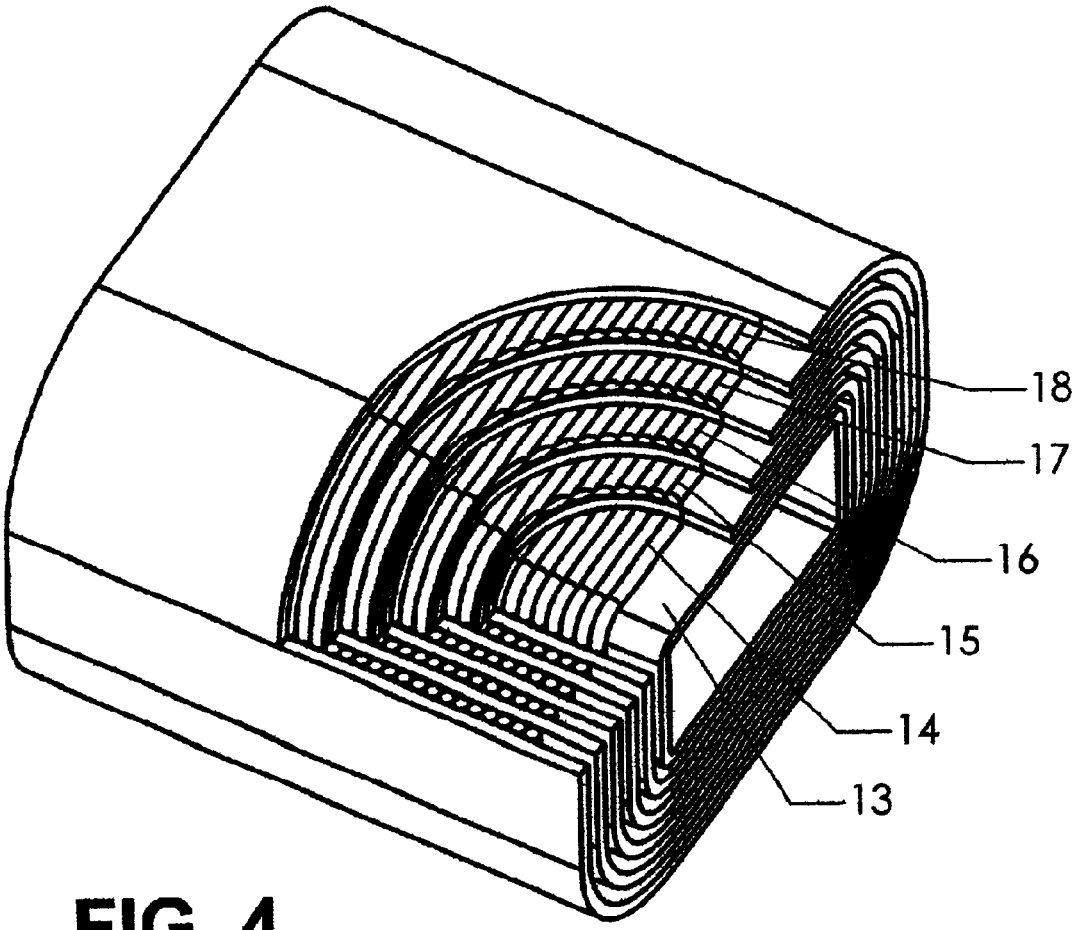
FIG. 4 is an isometric view of an alternate embodiment of the coil invention wound using a stick wound construction.

FIG. 4 shows an alternate embodiment of the coreless pulse type transformer of the invention and the proximity of multiple primary windings to multiple secondary windings using a stick wound construction. In FIG. 4, a paper tube 13 is provided as a frame to wind the first layer of transformer windings. The first layer of secondary windings 14, is wound over the paper tube 13. The first layer of primary windings 15 is wound over the first layer of secondary windings 14 with a layer of insulation between the windings. The second layer of secondary windings 16 is wound over the first layer of primary windings 15 again with a layer of insulation between the windings. The second layer of primary windings 17 is wound over the second layer of secondary windings 16 with a layer of insulation between the windings. The third and last layer of secondary windings 18 is wound over the second layer of primary windings 17 again with a layer of insulation between the windings. The alternating layers of primary and secondary windings in the coreless pulse transformer increases the number of primary windings in proximity to the number of secondary windings which also increases the coupling coefficient of the transformer compared to standard transformers where the primary winding or windings is located in one area and the secondary winding or windings is located in another area.

Figure 5:
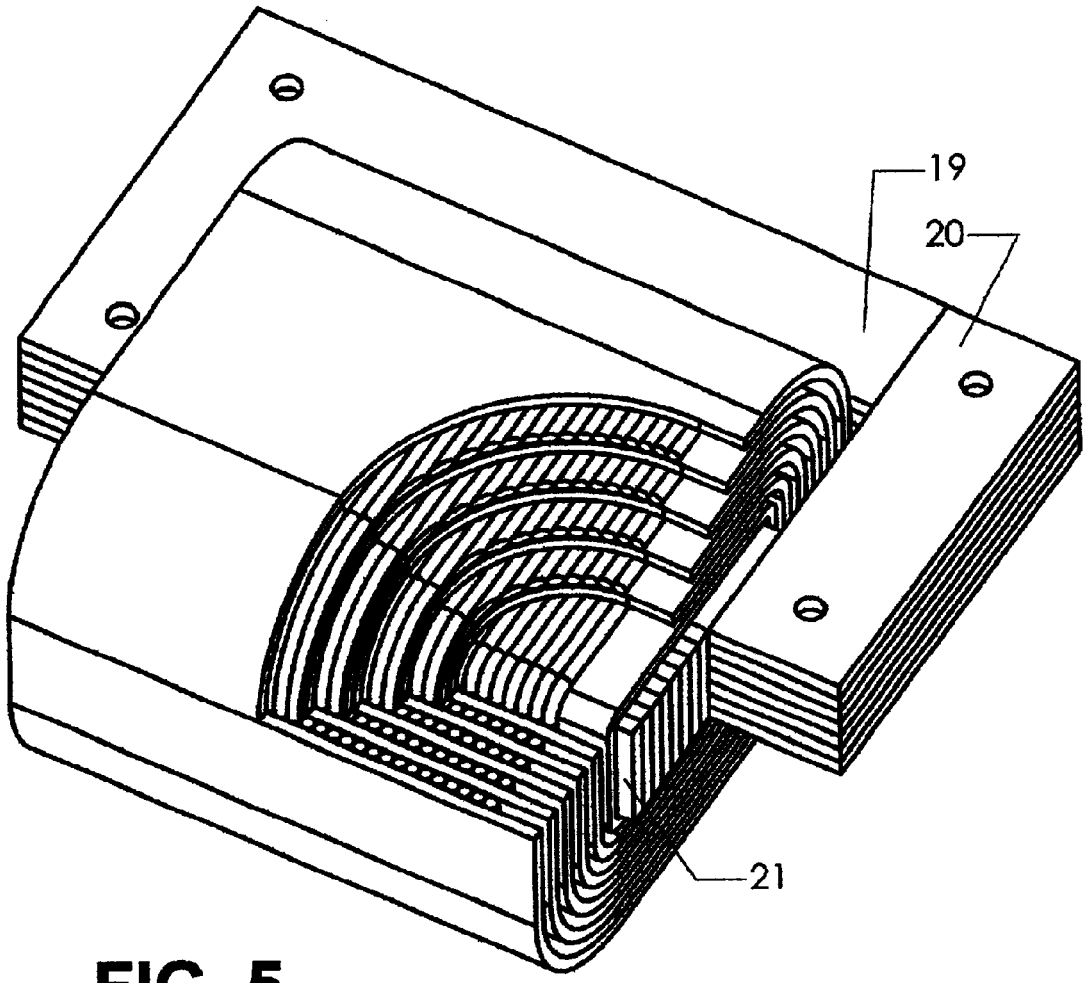
FIG. 5 is an isometric view of the coil construction shown in FIG. 4 along with an alternate embodiment of the magnetic core invention.
Figure 6:
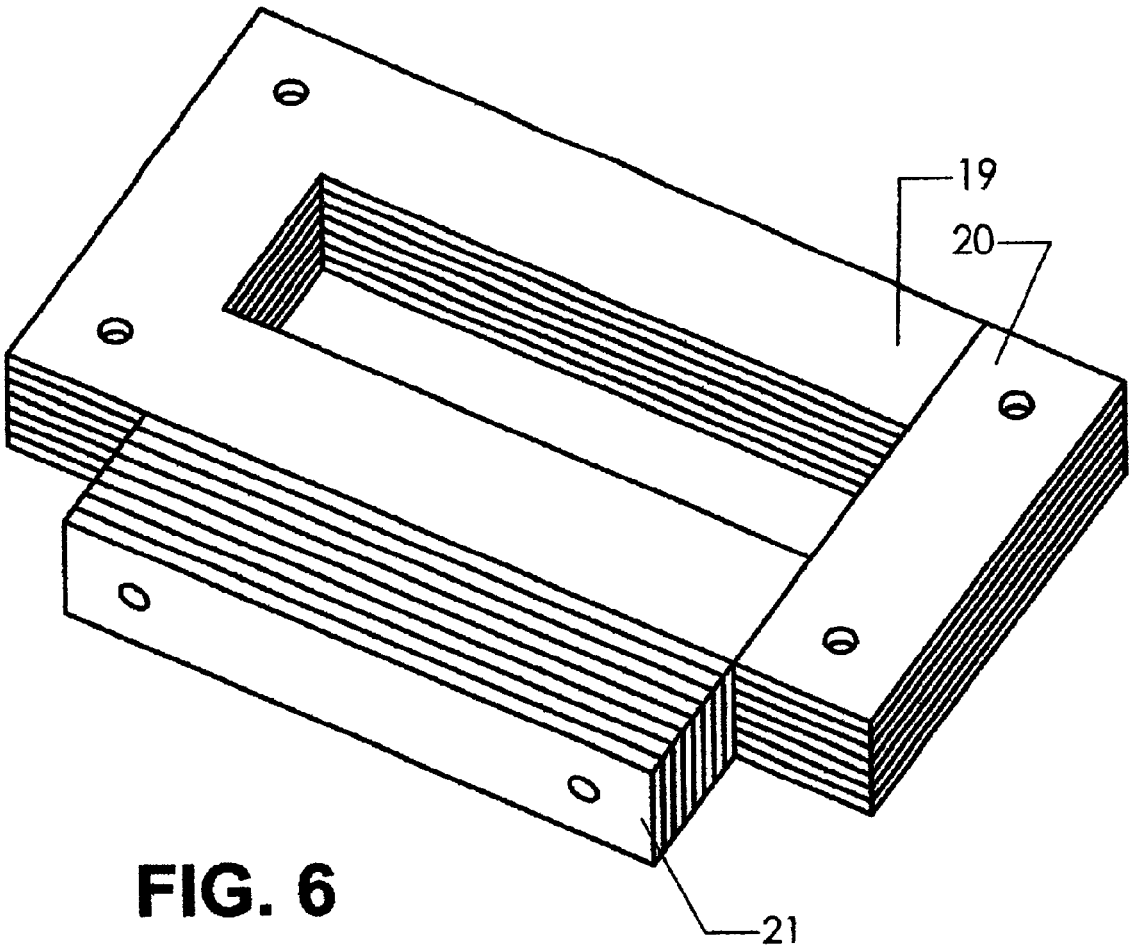
FIG. 6 is an isometric view of the alternate embodiment of the magnetic core invention shown in FIG. 5.

FIG. 5. shows the coil used in FIG. 4 along with an alternate embodiment of the magnetic core of the invention in relation to primary and secondary windings. FIG. 6 shows the magnetic core in FIG. 5 and the general shape related to the cross-sectional area within the primary and secondary windings along the magnetic path as compared to the cross-sectional area along the magnetic path outside the primary and secondary windings. The magnetic core is provided using two stacks of stamped transformer laminations with uniform cross-sectional area along with a stack of laminations to provide an increase in the cross-sectional area within the primary and secondary windings. The first stack of transformer laminations 19 provides a constant width along the magnetic core's magnetic path as it passes through and around the primary and secondary windings. The second stack of transformer laminations 20 also remains at the same width as the lamination 19 and completes the magnetic path through the windings. The additional stack of laminations 21 is placed next to lamination 19 within the primary and secondary windings to increase the cross-sectional area of the core within the primary and secondary windings. This increased cross-sectional area within the primary and/or secondary windings provides an increased coupling coefficient for a high peak current, low duty cycle, pulse type transformer.

While several preferred embodiments of the present invention have been described, it should be understood that various changes, adaptations, and modifications may be made therein without departing from the spirit of the invention and the scope of the appended claims.

What is claimed is:

1. A pulse type transformer connected to a high pulse current or capacitive discharge type circuit, comprising:

one or more primary windings;

one or more secondary windings; and a magnetic core such that the cross-sectional area of the core varies along the magnetic path such that the cross-sectional area within the primary winding or the cross-sectional area within the secondary winding is increased relative to the cross-sectional area of the core outside the primal winding or secondary winding;

wherein the high voltage or discharge type circuit delivers peak current in the primary winding is adequate to saturate the magnetic core;

wherein the primary and secondary windings positioned in close proximity to one the other and wound around a common section of the core with larger cross-sectional area.

2. A pulse type transformer of claim 1 where the transformer is provided with more than one layer of primary windings and provided with more than one layer of secondary windings such that the layers of secondary windings are physically located between the layers of primary windings.

3. A pulse type transformer of claim 1 where the transformer is provided with more than one winding bay of primary windings and provided with more than one winding bay of secondary windings such that the winding bays of secondary windings are physically located between the winding bays of primary windings.

* * * * *